US006092380A

United States Patent [19]

Kachur et al.

[11] Patent Number: 6,092,380

[45] Date of Patent: Jul. 25, 2000

[54] METHOD FOR REGULATING THE COOLING PERFORMANCE OF AN AIR CONDITIONING SYSTEM

[75] Inventors: Christopher M. Kachur, Amherst, N.Y.; Giles M. Brandon, Bascharage, Luxembourg; Ronald Joseph Goubeaux; Charles Andrew Archibald, both of Lockport, N.Y.; Ernesto Jose Gutierrez, Amherst, N.Y.; Francois M. Bancon, Montigny le Bretonneux, France; Vincent M. Braunschweig, Fontenay aux Roses, France; Jean Marie M. L'Huillier, Issy les Moulineaux, France

[73] Assignee: Delphi Technologies, Inc., Troy, Mich.

[21] Appl. No.: 09/197,925

[22] Filed: Nov. 23, 1998

[51] Int. Cl.[7] ..... F25B 1/00

[52] U.S. Cl. ..... 62/228.3; 62/209; 62/227

[58] Field of Search ..... 62/228.3, 228.5, 62/227, 208, 209

[56] References Cited

U.S. PATENT DOCUMENTS

| | | | |
|---|---|---|---|
| 3,362,185 | 1/1968 | Harnish | 62/201 |
| 4,439,997 | 4/1984 | Cantley | 62/175 |
| 4,723,416 | 2/1988 | Suzuki | 62/226 |
| 4,882,909 | 11/1989 | Terauchi | 62/209 |
| 5,440,891 | 8/1995 | Hindmon, Jr. et al. | 62/117 |
| 5,950,443 | 9/1999 | Meyer et al. | 62/228.5 |

*Primary Examiner*—Henry Bennett
*Assistant Examiner*—Marc Norman
*Attorney, Agent, or Firm*—Patrick M. Griffin

[57] ABSTRACT

In a method for the temperature regulation of an air conditioning system having a condenser, an evaporator, an expansion device and a compressor, the stroke of which can be set via a valve, the temperature in the region of the air outlet of the evaporator is measured and a desired temperature is set by a controlling of the valve. The temperature regulation additionally takes place in dependence on the refrigerant pressure.

7 Claims, 4 Drawing Sheets

METHOD FOR REGULATING THE COOLING PERFORMANCE OF AN AIR CONDITIONING SYSTEM

TECHNICAL FIELD

The present invention relates to a method for the temperature regulation of an air conditioning system and to an air conditioning system for carrying out the method.

BACKGROUND OF THE INVENTION

Air conditioning systems for the setting of a desired room climate are known in principle and have a condenser, an evaporator, an expansion device (either an orifice or a thermal expansion valve) and a compressor. Compressors with variable displacement are often used with an evaporator off air temperature or an evaporator fin temperature sensor in air conditioning systems, in particular automotive air conditioning systems.

SUMMARY OF THE INVENTION

An object of the present invention is to provide a method for the temperature regulation of an air conditioning system by means of which a more sensitive and more accurate control can be achieved.

A further object of the invention is to provide a method for the temperature regulation of an air conditioning system by means of which an undesirable engaging and disengaging of the clutch of the compressor can be prevented.

A further object of the invention is to provide an air conditioning system, in particular a vehicle air conditioning system, by means of which such a more accurate control can be realized.

In accordance with the present invention a method for the temperature regulation of an air conditioning system is provided which comprises a condenser, an evaporator, an expansion device and a compressor, the stroke of which can be set via a valve. In the method the temperature is measured in the region of the air outlet of the evaporator (at the evaporator air outlet or on an evaporator fin) and a desired temperature is set through a controlling of the valve. In this the temperature regulation is additionally done in dependence on the refrigerant pressure (high side or low side pressure), e.g. the refrigerant pressure at the outlet of the condenser.

An air conditioning system in accordance with the invention comprises a condenser, an evaporator, an expansion device and a compressor, the stroke of which can be set via a valve. A sensor is provided for the measurement of the temperature in the region of the air outlet of the evaporator and a further sensor serves for the measurement of the refrigerant pressure, e.g. at the outlet of the condenser. An electronic control system which controls the valve of the compressor in dependence on a desired temperature and on the signals of the sensors serves for the controlling of the air conditioning system.

Advantageous embodiments of the invention are described in the subordinate claims.

In accordance with the invention the temperature regulation can use two control loops, with these control loops being designed in particular as PID-regulators.

The control system in accordance with the invention preferably has two control loops which are connected together in the manner of a cascade, with a master and a slave control loop being present. The master loop of the circuit dictates a pressure (e.g. condenser outlet refrigerant pressure) setpoint required to achieve the desired evaporator outlet air temperature setpoint. The inner loop controls the refrigerant pressure to the setpoint pressure of the outer loop by controlling the operation of the valve.

The theory of the operation is based upon the concept that for any given thermal load on the air-conditioning system (and cooling capacity at the condenser) there will be a refrigerant pressure that corresponds to the desired temperature in the region of the evaporator (evaporator outlet air temperature). The goal of the outer loop (evaporator outlet air temperature controller) is to calculate the necessary refrigerant pressure setpoint to achieve the desired temperature setpoint. The goal of the inner loop (refrigerant pressure controller) is to calculate and output the proper signal (preferably a pulse width modulation (PWM) signal) to the valve so as to control the refrigerant pressure setpoint. Both loops are recalculated many times per second such that the refrigerant pressure setpoint may be a highly dynamic quantity based upon changes of vehicle speed, cooling fan voltage, blower voltage, ambient temperature, door positions or any other disturbance to the air-conditioning system.

The use of the refrigerant pressure as a feedback and control variable provides more immediate response to stroke changes than air temperature alone. The changes in the refrigerant pressure can be detected and thus used to prevent stroke oscillations, which leads to improved compressor durability.

In accordance with a further advantageous embodiment of the invention the refrigerant pressure can be regulated by the control system in such a manner that it does not exceed a predetermined pressure. In this variant embodiment a clutch cycling can be avoided which is in principle undesirable and which arises when a pressure switch which is present in the pressure circuit disengages the clutch as a result of the achieving of a switching pressure. In certain operating states it can happen that the clutch does not remain disengaged, but rather engages again after the pressure in the pressure circuit has fully or partially equalized and disengages again after a short time, through which the effect known as clutch cycling is brought about. With the method in accordance with the invention, however, it can be excluded that a clutch cycling of this kind arises, since the refrigerant pressure is fundamentally held within predetermined pressure limits, so that the pressure switch which is present in the pressure circuit does not respond.

The refrigerant pressure is preferably regulated in such a manner that it does not exceed a predetermined pressure in that the stroke of the compressor is reduced through a corresponding control of the valve.

The engaging and disengaging of the clutch, which is undesirable in principle, does not usually occur at a specific pressure, but rather in a pressure range which lies for example between 20 and 30 bar for the high side pressure and between 0 and 2 bar for the low side pressure. Therefore the refrigerant pressure is preferably regulated in such a manner that it lies below this critical pressure range.

In accordance with a further embodiment of the invention it can additionally be provided that the clutch of the compressor is disengaged from the control system when the refrigerant pressure (e.g. at the outlet of the condenser) exceeds a critical maximum high side or minimum low side pressure in order to increase the safety of the system.

The ability of the present method to control the refrigerant pressure will eliminate or drastically reduce any cycling of the clutch of the compressor due to over pressurization which is seen with known systems having a fixed displacement compressor or a variable displacement compressor with a pneumatic control valve. This will provide for more even cabin cooling at conditions such as idling at high load.

According to the present invention, there is no need for an electrically driven compressor or any other means of speed control.

BRIEF DESCRIPTION OF THE DRAWINGS

The present invention will now be described, by way of example, with reference to the accompanying drawings, in which.

DESCRIPTION OF THE PREFERRED EMBODIMENT

Figure 1:
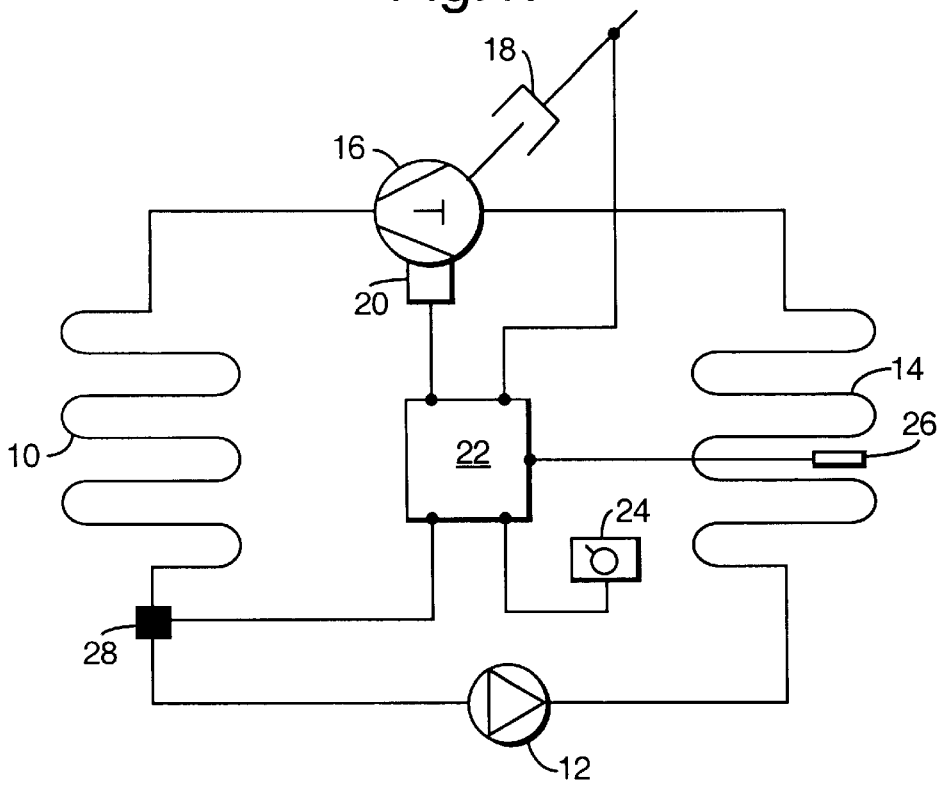
FIG. 1 is a schematic illustration of a first embodiment of an air conditioning system.

As shown in FIG. 1, an air conditioning system in accordance with the invention, which can in particular be designed as a vehicle air conditioning system, has a condenser 10, an expansion device 12, an evaporator 14 and a compressor 16, which are connected to one another in the named sequence. The compressor 16 is driven via a non-illustrated belt by the drive motor of a vehicle, with it being possible for the drive to be coupled in via a clutch 18.

The compressor is designed as a variable displacement compressor, with the displacement of the compressor being variable via a solenoid valve 20.

An electronic control system 22 is provided for the temperature regulation of the air conditioning system illustrated in FIG. 1. A setting unit 24 for the setting of a desired evaporator outlet temperature (cabin temperature) is connected to the control system 22. Furthermore, the control system 22 produces electric signals by means of a pulse width modulation which control the valve 20 of the compressor 16. The clutch 18 is likewise controlled by the control system 22, for example in order to effect a clutch engagement when the air conditioning system is switched on.

In this exemplary embodiment, a temperature sensor 26 which is connected to the control system 22 serves for the measurement of the evaporator outlet air temperature (called "eoat" in the following). Furthermore, a pressure sensor 28 is provided at the refrigerant outlet of the condenser 10 which establishes the condenser outlet refrigerant pressure (called "cdop" in the following) and transmits it to the control system 22.

Figure 2:
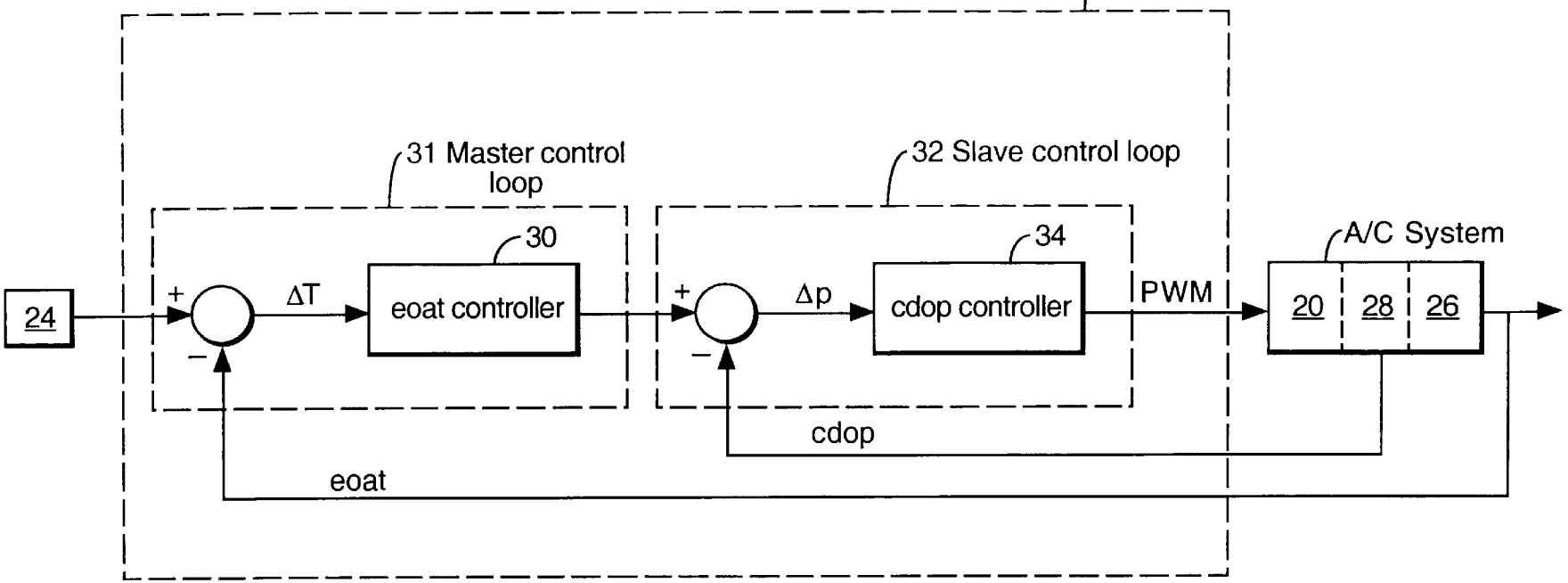
FIG. 2 is an illustration of the control loops used in accordance with the invention for the temperature regulation.

FIG. 2 shows the embedded control loops of the control system 22, which form a PID-cascade controller. The goal of this exemplary system is to control the eoat as measured roughly 1 cm from the core. The system is based on operation of two Proportional Integral Derivative (PID) control loops in a cascade configuration (output of first controller is the input to the second controller). The two PID loops consist of a "master" and a "slave". The master is the outer closed loop of FIG. 2 which represents the air temperature controller. The slave is the inner closed loop of FIG. 2 which represents the condenser pressure controller. Based on the actual and setpoint values of cdop, the slave controller outputs a duty cycle to the electronic control valve 20 which influences the stroke of the compressor. The evaporator off temperature (target) is determined by the setting unit 24. The cdop setpoint is a "moving target" as determined by the master PID loop.

As FIG. 2 shows, a desired evaporator outlet temperature (cabin temperature), which is input as a desired value to the master control loop 31, can be set with the help of the setting unit 24. The output signal of the temperature sensor 26, which outputs the respective value of the eoat, serves as the actual value for the control loop31. The master control loop calculates the temperature error $\Delta T$ which is the difference between the desired and actual eoat. This temperature error $\Delta T$ is converted in an eoat controller 30 into a desired pressure value for the outlet of the condenser 10. This desired value is input into the slave control loop 32, with the output signal cdop of the pressure sensor 28 being used as the actual value. The slave control loop calculates the pressure error $\Delta p$ which is the difference between the desired and the actual cdop. This pressure error $\Delta p$ is converted in a cdop controller 34 into control signals for the control of the electric valve 20.

In accordance with a further control feature of the control system 22 a specific high side pressure setpoint (usually between 20 and 30 bar) which is set below the limiting pressure value at which the initially described clutch cycling arises is provided as a safety measure. Consequently, the control method according to the present invention tries to destroke the compressor instead of allowing the high side pressure to increase unchecked to the clutch cycling limit.

According to the present invention, the condenser outlet pressure is controlled to a maximum limit of 26.5 bar. This was done in order to improve drivability by avoiding clutch cycling conditions which typically occur when the condenser outlet pressure exceeds 28.0 bar. As a safety feature, the cascade control strategy is also designed to cycle the clutch in the event of the condenser outlet pressure exceeding 28.0 bar.

Figure 3:
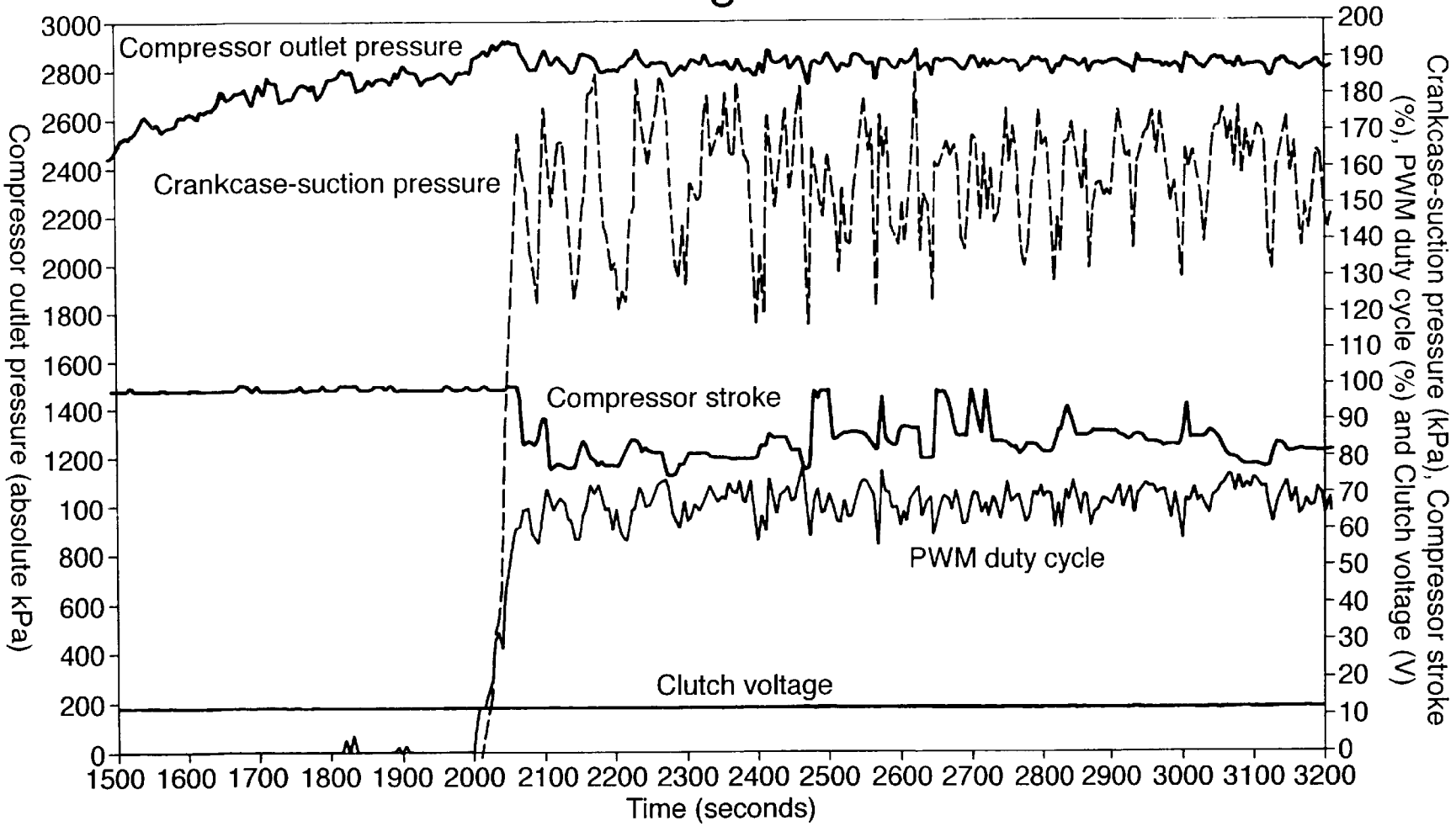
FIG. 3 is an illustration of test results, using the high side pressure, at an ambient temperature of 40° C.
Figure 4:
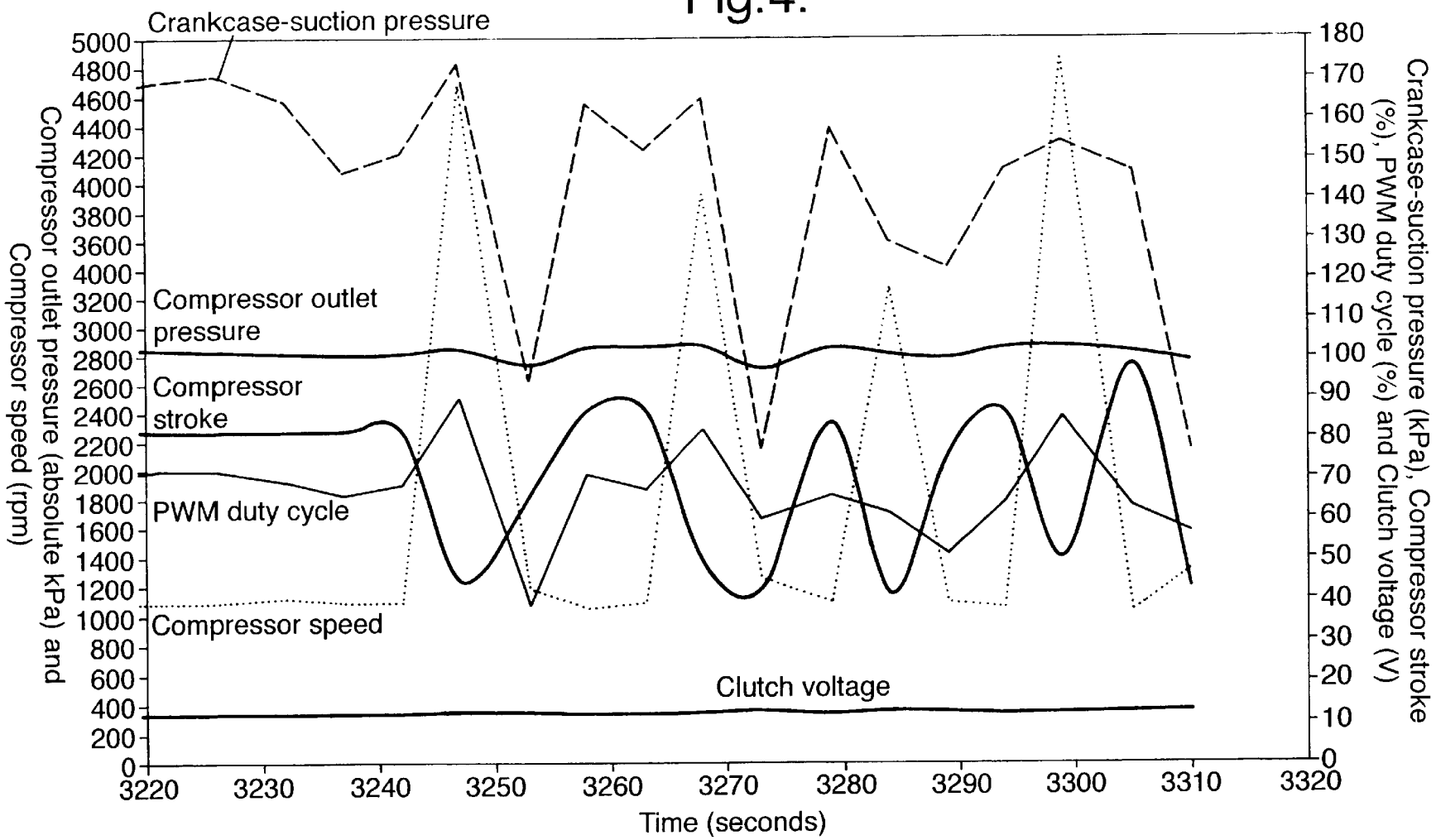
FIG. 4 is a further illustration of test results, using the high side pressure, at an ambient temperature of 40° C., wherein the speed of rotation of the compressor was varied.

FIGS. 3 and 4 show results of a test experiment in which a vehicle with an air conditioning system in accordance with the invention was tested at an ambient temperature of 40° C. The air-conditioning was set to maximum blower speed (setting 4), outside air and vent mode. The vehicle was allowed to idle long enough for the condenser outlet pressure to reach the control strategy limit. The compressor outlet pressure, crankcase-suction pressure, compressor stroke and clutch voltage were recorded in order to evaluate whether clutch cycling occurred.

As shown in FIG. 3, the cascade control strategy is able to regulate the condenser outlet pressure (cdop) at the 26.5 bars limit without needing to cycle the clutch. The compressor outlet pressure was regulated at 28±0.3 bars. The crankcase-suction pressure varied between 1.2 and 1.85 bar. This falls within the recommended safety limit of 2.1 bar.

The compressor stroke was controlled to approximately 85% stroke with some deviations to 80 and 100% stroke.

In a second stage of testing, several wide open throttles were also performed in neutral gear directly after the idle test in order to prove that the cascade control strategy prevents the condenser outlet pressure from reaching the clutch cycling limit. The results are shown in FIG. 4 which shows that the compressor speed varied from 1000 up to 5000 rpm during the wide open throttles. The cascade control strategy was able to regulate the condenser outlet pressure at the 26.5 bars limit without needing to cycle the clutch. The compressor outlet pressure was regulated at 28±1 bars. The crankcase-suction pressure varied between 0.8 and 1.75 bar. This falls within the recommended safety limit of 2.1 bar. The compressor stroke was controlled between 40% (high compressor speed) and 100% (idle compressor speed).

Figure 5:
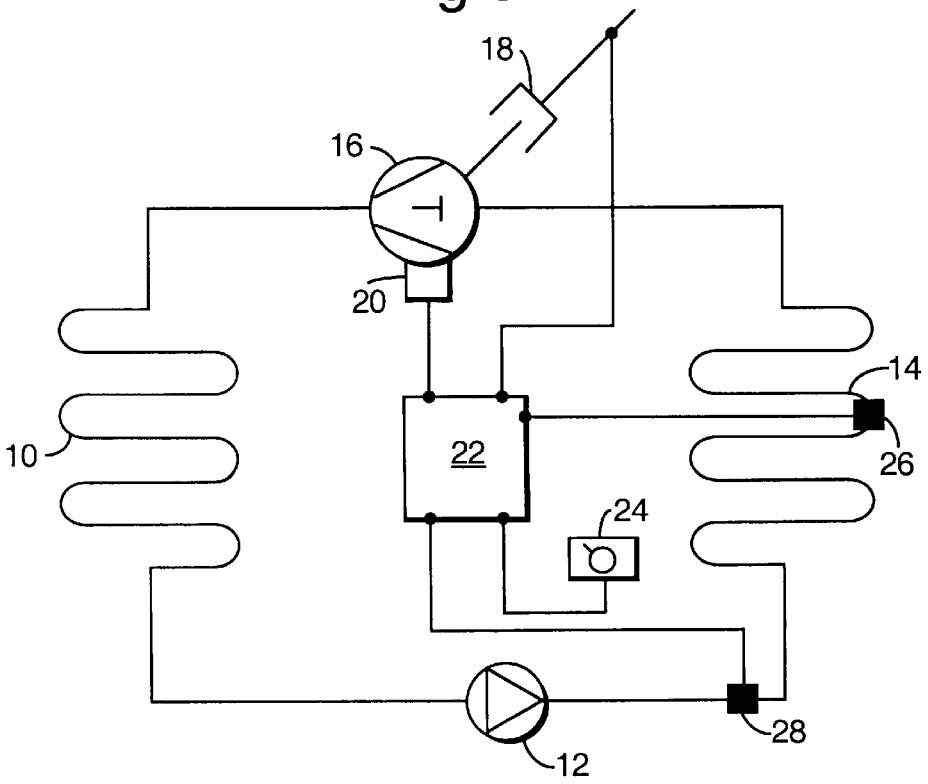
FIG. 5 is a schematic illustration of an alternative air conditioning system.

FIG. 5 shows an alternative embodiment of a system using an air-conditioning system similar to that of FIG. 1. However, in contrast to the first embodiment, the air-conditioning system according to FIG. 5 has a pressure sensor 28 mounted at the entrance of the evaporator 14 (low side pressure sensor). Further, the temperature sensor 26 is mounted on a fin of the evaporator 14.

It should be noted that the alternatives of FIG. 5 can be combined with the system shown in FIG. 1. This means that the pressure sensor 28 can alternatively be arranged on the high pressure side or on the low pressure side. Further, the pressure sensor 28 can be arranged at the input or at the output side of the condenser 10 and the evaporator 26, respectively. Further, it is possible to measure the evaporator outlet temperature, or alternatively, the evaporator fin temperature. If corresponding alternatives are chosen, the controllers 30 and 34 and the corresponding control loops 31 and 32 are to be adapted correspondingly.

What is claimed is:

1. A method for the temperature regulation of an air conditioning system having a condenser, an evaporator, an expansion device and a compressor, the stroke of which can be set via a valve, wherein the valve is controlled to achieve a desired temperature for an air conditioned compartment, the method comprising the steps of:

measuring a temperature in the region of the air outlet of the evaporator and a refrigerant pressure in the region of the condenser;

determining a desired refrigerant pressure for the region of the condenser based on a difference between the desired temperature of the compartment and the measured temperature of the evaporator outlet air; and controlling the valve based on a difference between the determined desired refrigerant pressure and the measured refrigerant pressure in the region of the condenser.

2. The method according to claim 1, wherein the desired refrigerant pressure is determined, and the valve is controlled, using PID regulators.

3. The method according to claim 1, wherein the refrigerant pressure is measured at an outlet of the condenser.

4. The method according to claim 1, wherein the desired refrigerant pressure is determined in such a manner that it does not exceed a predetermined pressure for the region of the condenser.

5. A control method for an air conditioning system including a refrigerant compressor having a stroke set by a valve, a condenser connected to receive high pressure refrigerant from the compressor, an expansion device connected to receive high pressure refrigerant from the condenser and to supply low pressure refrigerant to an evaporator which cools air that is delivered to an air conditioned compartment, the control method comprising the steps of:

measuring a temperature of the cooled air and a pressure of the high pressure refrigerant;

determining a desired pressure for the high pressure refrigerant based on a difference between the measured temperature of the cooled air and a desired temperature for the compartment;

determining a control signal for the valve based on a difference between the desired pressure for the high pressure refrigerant and the measured pressure of the high pressure refrigerant; and controlling the valve in accordance with the control signal.

6. The control method of claim 5, wherein the high pressure refrigerant is measured at an outlet of the condenser.

7. The control method of claim 5, wherein the desired pressure of the high pressure refrigerant is determined in such a manner that it does not exceed a predetermined pressure.

* * * * *

UNITED STATES PATENT AND TRADEMARK OFFICE

CERTIFICATE OF CORRECTION

PATENT NO. : 6,092,380
DATED : July 25, 2000
INVENTOR(S) : Christopher M. Kachur et al.

It is certified that error appears in the above-identified patent and that said Letters Patent is hereby corrected as shown below:

Title page,
Item [73], Assignee, should read:
-- Delphi Technologies, Inc., Troy, Mich.
Renault S.A., Boulogne Billancourt Cedex, France --.

Signed and Sealed this

Sixth Day of September, 2005

JON W. DUDAS
*Director of the United States Patent and Trademark Office*